United States Patent [19]

Calvert

[11] Patent Number: 4,905,846

[45] Date of Patent: Mar. 6, 1990

[54] GRAVITY FED DISPLAY AND DISPENSING APPARATUS

[75] Inventor: Peter W. Calvert, Johnson City, Tenn.

[73] Assignee: Thomas Industries, Inc., Johnson City, Tenn.

[21] Appl. No.: 202,689

[22] Filed: Jun. 6, 1988

[51] Int. Cl.[4] ..... A47F 7/00

[52] U.S. Cl. ..... 211/59.1; 211/59.2; 248/221.1

[58] Field of Search ..... 211/57.1, 54.1, 59.1, 211/59.2, 66; 248/220.3, 220.4, 221.1, 221.2

[56] References Cited

U.S. PATENT DOCUMENTS

| | | | |
|---|---|---|---|
| 3,897,926 | 8/1975 | Silver | 248/221.1 |
| 4,093,168 | 6/1978 | Buril | 211/57.1 X |
| 4,109,795 | 8/1978 | Konigsford et al. | 211/57.1 |
| 4,362,249 | 12/1982 | Thalenfeld | 211/59.1 |
| 4,436,209 | 3/1984 | Thalenfeld | 211/59.1 X |
| 4,475,658 | 10/1984 | Roberts | 248/220.4 X |
| 4,674,721 | 6/1987 | Thalenfeld | 211/59.1 X |
| 4,742,923 | 5/1988 | Calvert | 211/57.1 |

FOREIGN PATENT DOCUMENTS

| | | | |
|---|---|---|---|
| 2308335 | 11/1976 | France | 211/57.1 |

*Primary Examiner*—Ramon S. Britts
*Assistant Examiner*—K. Chotkowski
*Attorney, Agent, or Firm*—Hill, Van Santen, Steadman & Simpson

[57] ABSTRACT

An apparatus for suspending articles from a surface is disclosed having a head portion and one arm member extending outwardly from one side of the head portion, arranged at an angle with respect to the head portion and haivng at least two spaced apart detents near a free distal end. An article to be suspended is hung from the arm member. The detents are in the form of bends in the arm and serve to restrict the article's movement in a longitudinal direction with respect to the arm member. The articles are held at the more proximal second detent, thereby leaving the more distal first detent open to allow for easy replacement of an article.

15 Claims, 1 Drawing Sheet

FIG. 1
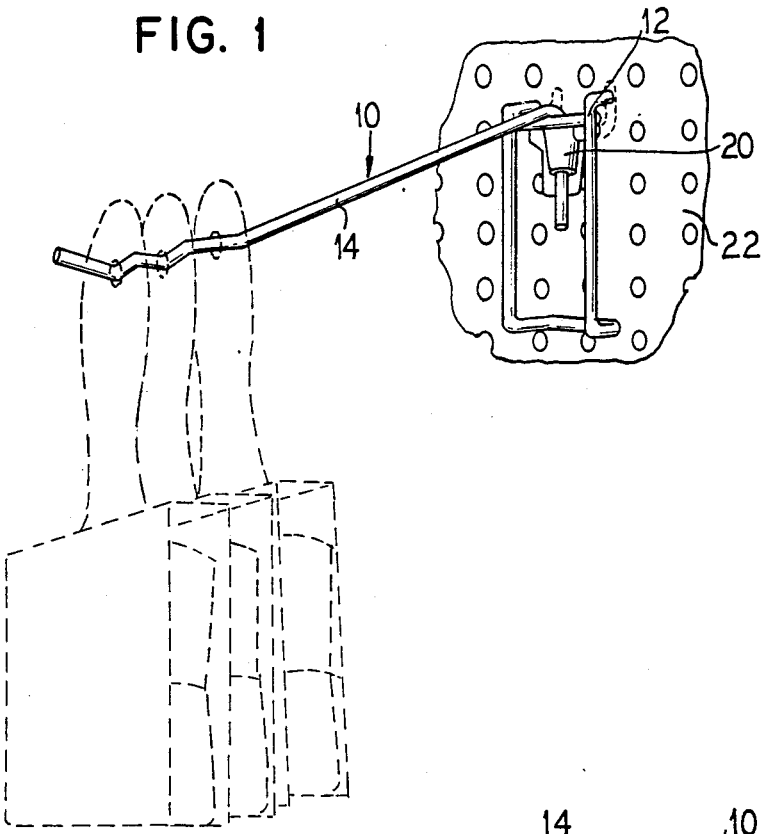
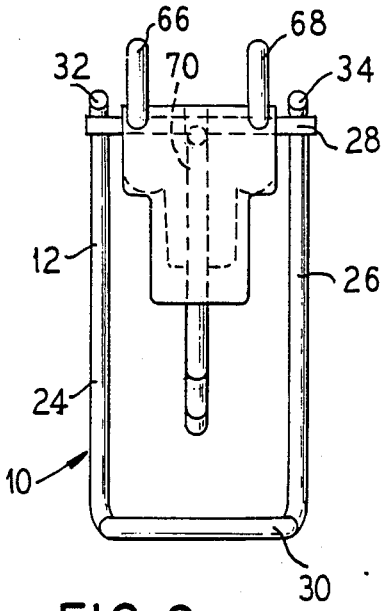
FIG. 2
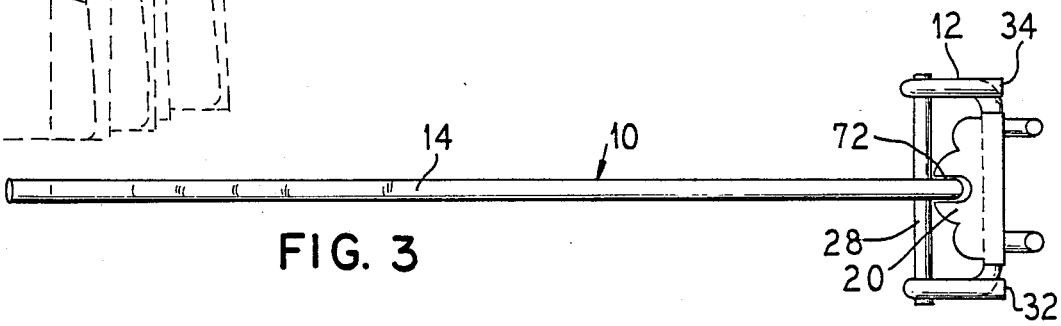
FIG. 3
FIG. 4
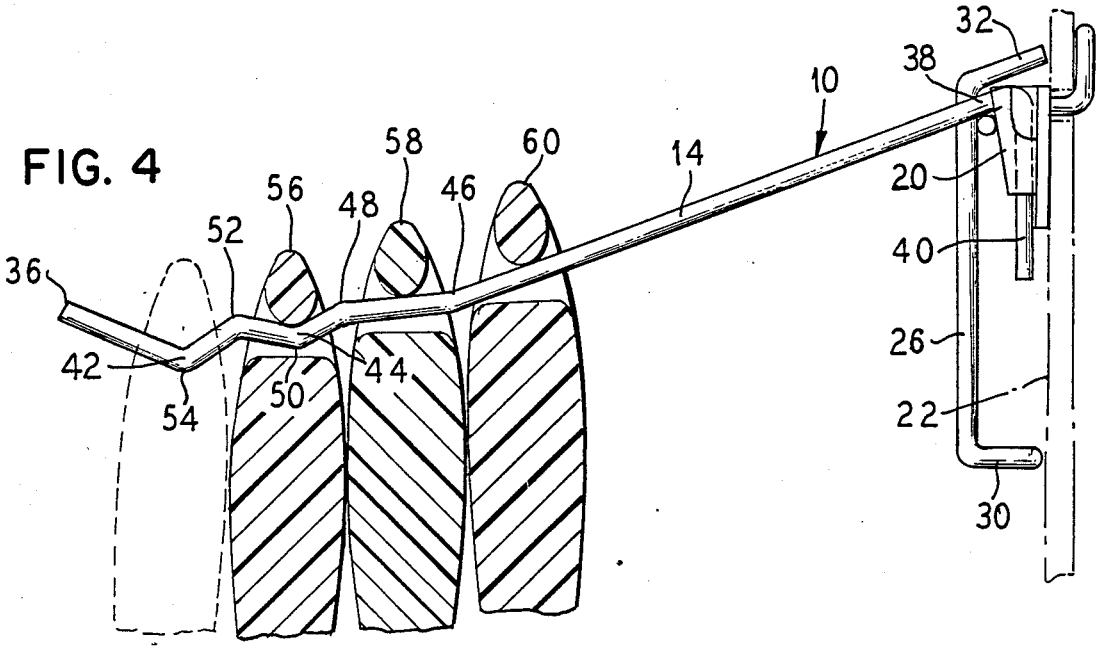

GRAVITY FED DISPLAY AND DISPENSING APPARATUS

BACKGROUND OF THE INVENTION

The present invention relates to a display apparatus and more particularly to a simple display and dispensing apparatus for articles which affixes to a pegboard, is gravity fed and provides for an easy, convenient replacement of the article by a customer after removal.

Display apparatus for pegboards are well known and are normally composed of a straight section of wire formed into a hook which is held within a desired hole of a pegboard. Articles to be displayed on such hooks normally have an aperture extending through the article which accepts the hook to create a hanging type display. Articles having handles are well suited for such a display, for example, paint brushes, having an aperture near one end of the handle.

Displays having just one wire extending from a pegboard have had the drawback in that they do not have an effective means by which the articles are continuously moved to the front of the wire for easy removal, nor do they have an effective means for preventing the articles from being pushed off the end of the wire by the remaining articles on the hook. Further, such displays do not include a means of permitting the customer to return an article to the display without also requiring that the customer adjust the position of all articles remaining on the display.

In a copending application, Ser. No. 040,189 assigned to the assignee of the present application there is disclosed a display which addresses some of these problems, but which requires the construction of a display having three extending wires, each configured in a different manner. Such a construction is more complex and costly than a single wire display.

OBJECTS AND SUMMARY OF THE INVENTION

It is therefore an object of the present invention to provide a novel apparatus for hanging articles from a display.

It is a feature of the present invention to have a single arm member extending from a central head member which is affixed directly to an upstanding display surface, which keeps a first article positioned near a free end of the arm, prevents subsequent articles from pushing the first article off the arm, and enables easy replacement of an article by the customer.

It is an advantage of the present invention that the apparatus can be adapted for use with a wide variety of articles, can readily be used with simple existing display structures, is gravity fed and is extremely cost effective.

Briefly, and in accordance with the foregoing object, the apparatus of the present invention is comprised of a head member and a single arm member which is affixed to and extends outwardly from the head member on one side at a slight downward angle with respect to the head member.

The arm member supports the article itself and includes a series of bends near a distal end thereof comprising at least two detents, a first detent closest to the distal end for receiving an article removed and replaced by a customer and a second detent for holding an otherwise first article in a ready-to-remove position where it may engage the returned article, if any, but does not push it off the arm. The arm slopes downwardly from the head to the distal end so that the articles are gravity fed towards the distal end. The arm is bent just prior to the second detent to reduce the slope of the arm to prevent a second article from pressing too hard on the firstd article which might cause it to move out of engagement with the second detent.

The apparatus of the present invention also utilizes a couple which readily affixes the apparatus to a pegboard. This couple can be modified to accept various forms of the apparatus and allows the apparatus to be easily repositioned on the pegboard.

BRIEF DESCRIPTION OF THE DRAWINGS

Further features and advantages of the present invention are set forth with particularity in the appended claims. The invention may best be understood by making reference to the following description, taken in conjunction with the accompanying drawings and the several figures of which like reference numerals identify identical elements and wherein:

FIG. 1 is a front perspective view of the apparatus of the present invention suspended from a pegboard and is loaded with paint brushes.

FIG. 2 is a rear view of the apparatus of the present invention.

FIG. 3 is a top view of the apparatus of the present invention; and

FIG. 4 is a side elevational view of the apparatus illustrated in FIG. 1, depicting the apparatus affixed to a pegboard and having paint brushes suspended from the apparatus.

DESCRIPTION OF THE PREFERRED EMBODIMENT

The principles of the present invention are incorporated in a display and dispensing apparatus generally indicated by numeral 10 in the drawings.

As FIGS. 1–3 illustrate, the apparatus 10 is composed of a head portion 12 and an arm member 14. The apparatus 10 is illustrated throughout the drawings in conjunction with a couple 20 which affixes the apparatus 10 to a flat surface 22 such as a pegboard, for example.

In the preferred embodiment, head portion 12 is formed from a single piece of hardened steel rod which is bent to the desired configuration. It is to be noted, however, that head portion 12 may be constructed from a variety of materials and may have a variety of shapes, all of which will accomplish the same function.

As FIG. 2 illustrates, the head portion 12 is composed of two side members 24 and 26, a cross member 28 and a bottom spacing member 30. The bottom spacing member 30 as well as top spacing members 32 and 34 of respective side members 24 and 26 are slightly bent away from the rear of the head portion 12. This rearward bend permits the head portion 12 to stand away from the pegboard 22 in use, thereby providing a space for couple 20. Additionally, an overall support of the apparatus 10 is provided by top spacing members 32 and 34, and the entire length of bottom spacing member 30 which contact the pegboard 22 and provide stability. The cross member 28 provides horizontal stability between the side members 24 and 26 as well as a support for arm member 14.

As illustrated in FIG. 4, arm member 14 has a distal end 36 and a proximal end 38 which, in the preferred embodiment, is welded to the center of cross member 28. Furthermore, the proximal end 38 of first arm member 14 extends beyond cross member 28 and is bent downward with respect to the head portion 12 to form an engagement leg member 40. This engagement leg member 40 interfaces directly with the couple 20 and lies in the standoff space created by the bottom spacing member 30 and the top spacing members 32 and 34 of side members 24 and 26 respectively.

The arm member 14 is affixed to the head portion 12 and may be arranged at a slight angle toward the bottom spacing member 30 of head portion 12 in the preferred embodiment. This slight angle provides a gravity feed for the paint brushes or similar articles which are suspended from the arm member 14. As the drawings illustrate, gravity forces the articles downward and away from head portion 12 and toward the customer when in use. This design thereby aligns the articles one behind the other while advancing the next brush to the front of the apparatus 10 so that the display always has a full appearance thereby reducing the amount of in-store housekeeping.

To prevent the articles carried on the arm 14 from falling off the distal end 36, a first detent 42 is formed in the arm near the distal end and a second detent 44 is formed in the arm spaced away from the first detent, toward the proximal end 38. Still farther toward the proximal end 38 is a bend 46 in the arm which changes the downward slope of the arm 14 to a lesser slope. The second detent preferably is formed by a first bend 48 causing the arm to slope downwardly to a greater extent and a second bend 50 causing the arm to then slope upwardly. The first detent is preferably formed by a first bend 52 causing the arm to slope downwardly and a second bend 54 causing the distal end of the arm to slope upwardly. Other detent arrangements may be used as will be evident to those skilled in the art.

When a full load of articles such as paint brushes, is applied onto the arm 14 by a person restocking the display, and the arm is held in the couple 20 against the vertical surface 22, the articles will slide under the influence of gravity toward the distal end 36. A first, most distal article 56 will be captured by the second detent 44, a second article 58 will reside on the portion of the arm between the bend 46 and the second detent 44, which has a minimal downward slope, thereby preventing this article from pressing against the first article to such an extent so as to push the first article more toward the distal end. Subsequent articles 60 will line up behind the second article 58. Thus, the length of the arm between the bend 46 and the second detent 44, which comprises the lesser sloped portion, has a length at least as great as a thickness of the articles being carried on the arm. Similarly, the first and second detents 42, 44 are spaced apart by at least approximately the thickness of the articles being displayed.

The first article 56 may be manually moved to the first detent 42, and upon such movement, the second article 58 will be free to move into the second detent 44, and will be caused to move in such direction because of the slope of the arm between the first bend 46 and the second detent 44 as well as due to forward pressure by the third and subsequent articles 60. The first article 56 is then in a position for easy removal by a customer by merely sliding the article up the final upwardly sloped portion of the arm 14 at the distal end 36. If the customer subsequently decides not to purchase the article, the article may be easily replaced on the arm since the first detent area 42 will remain open. The article captured by the second detent 44 will not move into the area of the first detent on its own, but requires a manual force to move it to the first detent area.

In this manner, an article can be easily removed from the arm, even if it is held in a second detent area by manually causing the article to slide over bend 52 into the first detent area and then slipping the article upwardly off the distal end of the arm. The first detent area then remains clear for replacement of the article if it is determined to be unwanted by the customer. The customer need not press the remaining balance of articles back upwardly along the arm just to replace an unwanted article since the first detent remains clear.

As illustrated in FIGS. 2, 3 and 4, couple 20 is comprised of two upstanding hook members 66 and 68 which are inserted into the holes of the pegboard for suspending the apparatus 10. Additionally, couple 20 has a central aperture 70 which extends through the couple 20. This aperture 70 is slightly beveled and has a channel 72 formed in its top surface. The aperture 70 and the channel 72 accept the engagement leg member 40 of first arm member 14 to affix the apparatus 10 to the pegboard 22. The channel 72 also prevents rotation of the engagement leg member 40 within the couple 20 and provides a set angle for the apparatus 10 with respect to the pegboard 22.

In operation, couple 20 is affixed to pegboard 22 by inserting hook members 66 and 68 into the desired holes of the pegboard 22. Next, the engagement leg member 40 of the arm member 14 is inserted within the aperture 70 of couple 20 until the proximal end 38 of the arm member 14 is seated within the channel 72. In this position, the top spacing members 32 and 34 of sides 24 and 26 respectively as well as the bottom spacing member 30 of head portion 12 should contact pegboard 22 to further prevent rotation of the apparatus 10 around the engagement leg member 40 of the arm member 14 and to provide additional vertical support to the apparatus 10 upon its engagement with pegboard 22.

As illustrated in FIG. 1, several articles to be displayed, such as paint brushes, are loaded onto the distal end 36 of arm member 24, are advanced past the first detent 42 and second detent 44 until the apparatus 10 is completely loaded or until a desired number of articles are placed on the arm member 14.

With this arrangement, when not in use, the most forward article is suspended from the arm member 14 at the second detent 44 with the remaining articles stacked neatly behind it.

To remove an article from the apparatus 10, the leading article is moved out of the second detent into the first detent, unless it is already held at the first detent, and then it is slid upwardly and forwardly off the distal end 36 of the arm 14. When the leading article is removed in this manner, it can readily be understood that gravity forces the remaining articles downward along first arm member 14 until a new first article is held by the second detent to once again maintain the desired stacked arrangement.

For replacement, normally by the consumer, the article is merely placed back onto the distal end 36 of first arm member 14 where it will then slide by gravity along the distal end portion and into the first detent 42. This is advantageous since the consumer does not have to perform any further steps to reload the article back onto the apparatus 10 which would normally involve pushing the remaining articles back up the arm member 14.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of my contribution to the art.

I claim as my invention:

1. An apparatus for suspending articles from a flat surface comprising:

a head portion having a front and rear side;

an arm member having distal and a proximal ends, said proximal end being affixed to said head portion on said front side of said head portion near a top edge of said head portion, said arm member being affixed at an acute angle with respect to said head portion, said angle being toward the interior of said head portion, said arm member having a first detent near said distal end, said arm member having a second detent spaced from said first detent toward said proximal end of said arm member, said arm member having a first bend between said proximal end and said second detent to increase the size of said angle distally of said first bend; and means for affixing said rear side of said head portion to said flat surface, such that an article to be suspended hangs from said arm member at said second detent and said second detent restricts the article's movement in a longitudinal direction with respect to said arm member.

2. The apparatus of claim 1, wherein said detents comprise bends formed in said arm member.

3. The apparatus of claim 2, wherein said detents each comprise a pair of spaced, oppositely directed bends.

4. The apparatus of claim 1, wherein said head portion has a standoff means on its rear side for spacing the head portion from the flat surface.

5. The apparatus of claim 1, wherein said head portion has an engagement means on its rear side for engagement with said means for affixing.

6. The apparatus of claim 5, wherein said means for affixing is comprised of a couple which is affixed to the flat surface and engages said engagement means of said head portion.

7. A display apparatus for suspending articles from a pegboard surface comprising:

a head portion having front and rear sides, said rear side having standoff means for spacing and supporting said head portion from said pegboard surface and a leg member affixed near a top side of said rear side of said head portion extending toward a bottom edge of said rear side of said head portion a predetermined distance;

an arm member having a proximal end affixed to said front side of said head portion at an downward slope with respect to said head portion and a free distal end;

said arm member being affixed near the top edge of said head portion, said arm member having a first distal detent and a second proximal detent near its distal end, and said arm member having a first bend between said proximal end and said second detent to reduce said downward slope of said arm member distally of said first bend; and a couple, having two outwardly projecting legs for insertion into the apertures of the pegboard, said couple having a central beveled aperture through its center, an exterior bevelled end, and a channel on its exterior beveled end perpendicular to said aperture, such that said couple is affixed to the pegboard and said leg member of said head portion is inserted within said aperture and said channel of said couple so that said arm member extends at a downward angle from its proximal end, and an article to be suspended hangs from said arm member and extends between said second detent restricts the article's movement in a longitudinal direction with respect to said arm member.

8. The apparatus of claim 7, wherein said first bend is spaced from said second detent a distance at least approximately as great as a thickness of the articles to be suspended.

9. The apparatus of claim 7, wherein said first and second detents comprise bends formed in said arm member.

10. The apparatus of claim 9, wherein said first and second detents are spaced apart a distance at least approximately equal to a thickness of the articles to be suspended.

11. An apparatus for suspending articles to be displayed, comprising first means for affixing said apparatus to a surface, second means projecting from said first means at a proximal end away from said surface and having a distal end, said second means including a projection member having a pair of spaced apart detents adjacent said distal end thereof, said projecting member projecting from said first means such that when said apparatus is affixed to a vertical surface said projecting member extends at an acute angle downwardly and outwardly away from said surface, said projecting member having a first bend between said proximal end and said detents to increase the size of the angle from vertical distally of said first bend.

12. An apparatus according to claim 11, wherein said detents comprise bends formed in said projecting member.

13. A display device for displaying hangable articles comprising a first means adapted to be affixed to a display surface, a projecting member attached at a proximal end to said first means and projecting therefrom away from said surface, said projecting member being rod-like and terminating in a distal end, including first and second spaced-apart detents along the length of said member, said member being fixed to said first means such that when said first means is affixed to a vertical surface, said first member extends at an acute angle outwardly and downwardly away from said surface terminating in said distal end projecting outwardly, said projecting member having a first bend between said proximal end and said detents to increase the size of the angle from vertical distally of said first bend.

14. A display device according to claim 13, wherein said second detent is formed by a pair of spaced, oppositely directed bends between said first detent and said first bend; and said first detent is formed by a pair of spaced, oppositely directed bends distally of said second detent such that a most distal end portion of said member extends outwardly at an upward angle.

15. A display device according to claim 14, wherein said first and second detents are spaced apart a distance at least approximately equal to a thickness of the articles hanging therefrom.

* * * * *